US006843315B2

(12) United States Patent
Coronado et al.

(10) Patent No.: US 6,843,315 B2
(45) Date of Patent: Jan. 18, 2005

(54) COMPRESSION SET, LARGE EXPANSION PACKING ELEMENT FOR DOWNHOLE PLUGS OR PACKERS

(75) Inventors: Martin P. Coronado, Cypress, TX (US); Dennis G. Jiral, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 27 days.

(21) Appl. No.: 10/164,113

(22) Filed: Jun. 5, 2002

(65) Prior Publication Data

US 2002/0195244 A1 Dec. 26, 2002

Related U.S. Application Data

(60) Provisional application No. 60/296,666, filed on Jun. 7, 2001.

(51) Int. Cl.[7] ..... E21B 33/128; E21B 23/06

(52) U.S. Cl. ..... 166/196; 166/127; 166/387; 277/338

(58) Field of Search ..... 166/381, 387, 166/179, 118, 127, 191, 195, 196, 206; 277/322, 336, 337, 338

(56) References Cited

U.S. PATENT DOCUMENTS

| | | | | |
|---|---|---|---|---|
| 2,132,723 A | | 10/1938 | Crickmer et al. | |
| 2,254,060 A | | 8/1941 | Crickmer | |
| 2,612,953 A | | 10/1952 | Morgan et al. | |
| 2,660,247 A | | 11/1953 | Sweet | |
| 2,699,214 A | | 1/1955 | Sweet | |
| 2,738,013 A | | 3/1956 | Lynes | |
| 2,738,014 A | | 3/1956 | Lynes | |
| 2,738,015 A | | 3/1956 | Lynes | |
| 3,288,222 A | | 11/1966 | Urbanosky | |
| 3,392,785 A | | 7/1968 | King | |
| 3,776,561 A | | 12/1973 | Haney | |
| 3,784,214 A | | 1/1974 | Tamplen | |
| 4,253,676 A | * | 3/1981 | Baker et al. | 277/334 |
| 4,258,926 A | | 3/1981 | Upton | |
| 4,349,204 A | * | 9/1982 | Malone | 277/334 |
| 4,372,562 A | * | 2/1983 | Carter, Jr. | 277/334 |
| 4,640,351 A | * | 2/1987 | Clifton et al. | 166/127 |
| 4,730,835 A | * | 3/1988 | Wilcox et al. | 277/342 |
| 4,745,972 A | * | 5/1988 | Bell et al. | 277/338 |
| 4,897,139 A | * | 1/1990 | Wood | 156/188 |
| 4,979,570 A | * | 12/1990 | Mody | 166/387 |
| 5,101,908 A | * | 4/1992 | Mody | 166/387 |
| 5,261,492 A | * | 11/1993 | Duell et al. | 166/387 |
| 5,469,919 A | * | 11/1995 | Carisella | 166/387 |
| 5,676,384 A | | 10/1997 | Culpepper | |
| 5,775,429 A | | 7/1998 | Arizmendi et al. | |
| 5,904,354 A | | 5/1999 | Collins | |
| 5,941,313 A | | 8/1999 | Arizmendi | |
| 6,578,638 B2 | * | 6/2003 | Guillory et al. | 166/387 |

FOREIGN PATENT DOCUMENTS

| | | |
|---|---|---|
| WO | WO 97/09512 | 3/1997 |

* cited by examiner

*Primary Examiner*—David Bagnell
*Assistant Examiner*—Jennifer H Gay
(74) *Attorney, Agent, or Firm*—Steve Rosenblatt

(57) ABSTRACT

A packing element, which is a composite structure, contains the sealing portion to minimize extrusion. The element is retained in tension when running in to minimize damage. In the preferred embodiment, a collapsing sleeve transfers setting force applied at one end, to the opposite end to avoid the problem of bunching up the element adjacent to where it is being compressed which could, if not addressed, result in insufficiently low sealing contact pressure in regions remote from where the pushing force is applied.

20 Claims, 4 Drawing Sheets

COMPRESSION SET, LARGE EXPANSION PACKING ELEMENT FOR DOWNHOLE PLUGS OR PACKERS

This application claims the benefit of U.S. Provisional Application No. 60/296,666, filed on Jun. 7, 2001.

FIELD OF THE INVENTION

The field of this invention is packers or plugs which undergo large expansions to set, such as through tubing, followed by setting in casing or open hole.

BACKGROUND OF THE INVENTION

In through tubing and open hole applications, annular seals are required which have large radial expansion capabilities. For mechanically set elements, the larger the required radial expansion, the more serious the problem of element extrusion under high differential pressure loads. Extrusion would occur beyond the end rings placed there to control that condition. Various designs for backup rings have been tried with only limited success with the exception being where the extrusion gap around such rings is kept to a minimum. This situation usually involved a traditional casing packer application. Prior designs, in large expansion applications have allowed a gap to exist, which has been sufficiently large to allow extrusion to occur.

Another problem plaguing prior designs of mechanically set packers has been the inability to get a proper set over the length of the element. This happened because element would be pushed from a first end and start to set from that end. If the end near where the setting force was being applied engaged the casing or the open hole, further pushing would not allow the balance of the element to be firmly pressed against the casing or borehole.

The preferred embodiment of the present invention addresses these shortcomings of the past designs. It has a mechanism for setting from the end opposite of where the pushing force is being applied. Because of this, very long elements can be reliably mechanically set. The sealing element assembly includes a composite structure, which effectively closes the extrusion gap regardless of the large expansion. While the preferred embodiment accomplishes these objectives, the scope of the invention is far broader as will be explained in detail below and illustrated in the claims.

Of interest with regard to prior designs are U.S. Pat. Nos. 2,132,723; 2.254,060; 2,660,247; 2,699214; 2,738,013; 2,738,014; 2,738,015; 3,392,785; 3,784,214; 4,258,926; 5,775,429; 5,904,354; and 5,941,313. Of more interest among this group of patents is U.S. Pat. No. 5,941,313. It discloses using deformable sheaths surrounding a material placed therein. This structure is taught for service as a main seal or a backup member to the seal but not both. The sheath is a thin walled tubular member formed from a metallic or other material having sufficient strength and elasticity to bend without fracturing. In some embodiments, a resilient material is overlaid on the sheath but no provisions are made to keep this layer from extruding upon set. In another embodiment, exterior deformation surfaces interact with the sheath to redirect its deformation. No explanation is offered as to how pushing on the sheath at a second end results in initial deformation of the sheath against the exterior deformation surface adjacent the first end.

Testing by applicants has shown that one major concern with pressure set elements is that the element portions closer to where the element is being pushed expand first. This has the potential of weakening the grip of the remaining portions of the element. The present invention overcomes this problem by temporarily stiffening the end being pushed on to allow the remainder of the sealing element to contact the casing or the well bore. Thereafter, with the remote part of the element against a firm support, the proximate portion of the element is forced into sealing contact, overcoming the temporary stiffening. The invention encompasses a variety of ways to accomplish this objective and to prevent or minimize extrusion after the set.

SUMMARY OF THE INVENTION

A packing element, which is a composite structure, is disclosed. Components contain the sealing portion to minimize extrusion. The element is retained in tension when running in to minimize damage. In the preferred embodiment, a collapsing sleeve transfers setting force applied at one end, to the opposite end to avoid the problem of bunching up the element adjacent to where it is being compressed which could, if not addressed, result in insufficiently low sealing contact pressure in regions remote from where the pushing force is applied.

DETAILED DESCRIPTION OF THE DRAWINGS

DETAILED DESCRIPTION OF THE PREFERRED EMBODIMENT

Figure 1:
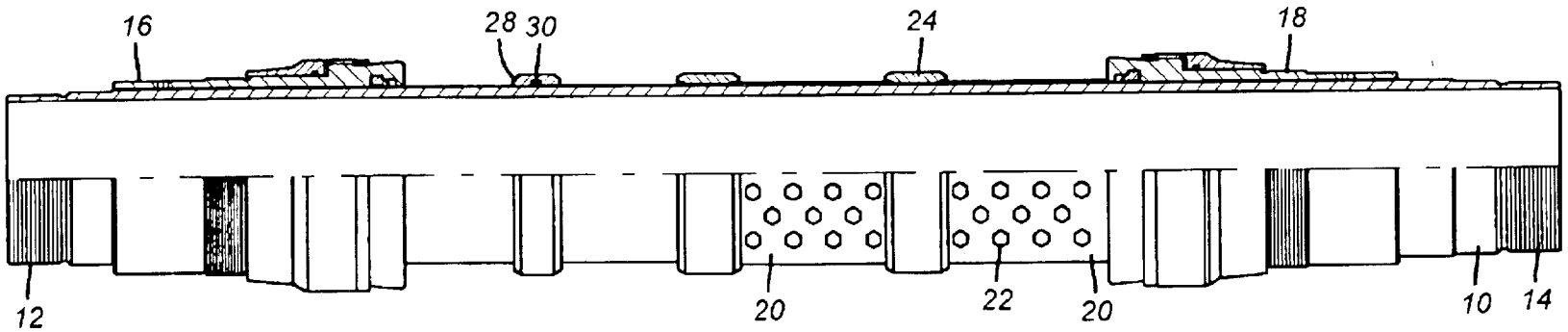
FIG. 1 is an outer view, partly in section, showing the innermost components adjacent to the mandrel.
Figure 2:
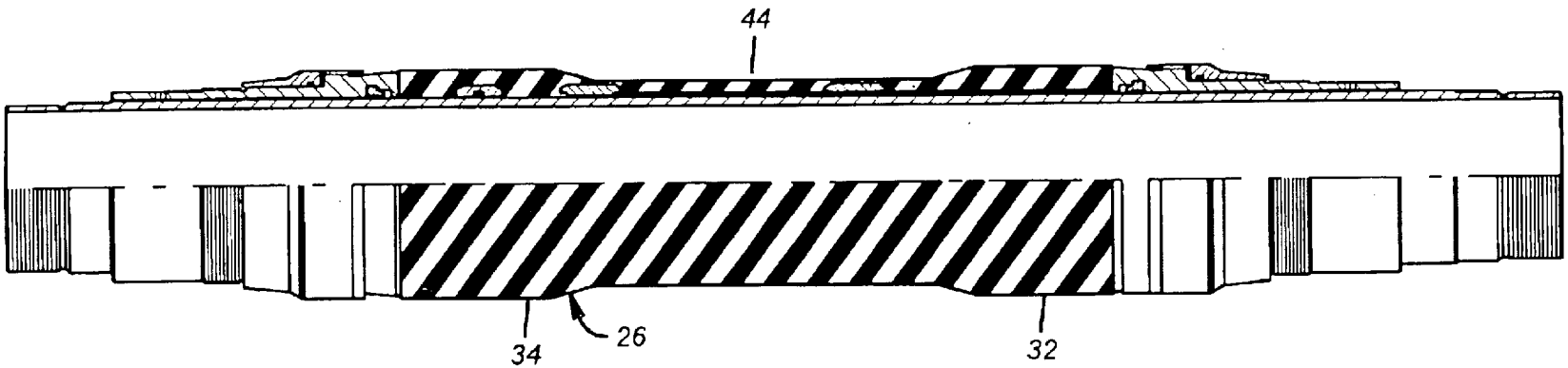
FIG. 2 is the view of FIG. 1 showing the internal sealing element.

Referring to FIGS. 1 and 2 the mandrel 10 has a top thread 12 and a bottom thread 14 to allow running into a well. It further comprises a stationary sleeve 16 and a movable sleeve 18. Sleeve 18 may be actuated in an up-hole direction by known techniques such as use of wellbore hydrostatic pressure against an atmospheric chamber or applied mechanical or hydraulic pressure or combinations of the above. On top of the mandrel 10 are a pair of collapsing sleeves 20 which preferably have openings 22 to selectively weaken them. In between the sleeves 20 is a spacer 24, which preferably distributes what would be essentially a line contact between ends of sleeves 20 if they were stacked end to end. The spacer 24 can have opposing female receptacles to allow ends of adjacent sleeves 20 to be inserted so they can be guided and held in alignment as a force is applied to movable sleeve 18. The reasons for using sleeves 20 can be better understood by examining FIGS. 1 and 2 together. As shown in FIG. 2, the internal sealing element 26 spans over sleeves 20 and spacer 24 as it extends between stationary sleeve 16 and movable sleeve 18. It also covers a seal ring 28, which has an internal o-ring 30 for the purpose of internal sealing along the mandrel 10. The problem addressed by sleeves 20 is that when movable sleeve 18 is set in up-hole motion, the element 26, in the absence of sleeves 20 will tend to bunch up and contact the casing or wellbore at end 32 rather than uniformly along its length or more preferably from the up-hole end 34. Expansion initially at end 32 is not desirable because it can prevent sufficient contact pressure from reaching the up-hole end 34 for a proper seal.

The present invention seeks to direct the pushing force from movable sleeve 18 through a mechanism other than the seal 26 for a predetermined portion of its length. Sleeves 20 have sufficient structural rigidity to redirect the pushing force from movable sleeve 18 to the up-hole segment 34 of the sealing element 26 such that the up-hole segment expands first into contact with the casing, tubular or wellbore. After sufficient contact pressure develops, further pushing by movable sleeve 18 collapses one or both sleeves 20 to allow the pushing force from movable sleeve 18 to go into the lower end 32 of the seal 26 and push it out into sealing contact in the manner just accomplished for up-hole segment 34. The openings 22 are designed to allow sleeves 20 to buckle after up-hole segment 34 is in sealing contact, at which point, in the preferred embodiment they serve no further significant structural purpose. Sealing force on the lower segment 32 of the seal 26 is principally determined by the pushing force into the resilient lower segment 32 after the upper segment has set. Those skilled in the art can appreciate that one or more sleeves can be uses and that each sleeve can be in round or other cross-sectional shape. The column strength of multiple sleeves or even of a single sleeve 20 can vary along its length, by a variety of techniques. The opening, pattern, number, or size can be varied and/or the wall thickness can change along the length. Different materials can be used along the length. The objective of the various combinations described is to have sufficient aggregate column strength to transfer initial expansion by compression of seal 26 to its upper segment 34 first, through the sleeve or sleeves 20. It is then preferred that after buckling. The sleeves 20 play a minimal part in the compression of the remainder of seal 26, while recognizing that the mere presence of the collapsed sleeve 20 in the lower end 32 will, by its mere presence distribute some pushing force from movable sleeve 18 to lower end 32. It should also be noted that sleeve or sleeves 20 could be complete cylinders, with or without a seam or sheet turned into a cylindrical shape or other shape by scrolling. Sleeves 20 can have longitudinal corrugations as another technique for adjusting their column strength. Instead of sleeves, other structures that have column strength to a point and then will buckle can be used to get the desired movement of seal 26 as described above. Some examples are stacked beveled washers, springs, rods and similar elongated structures that ultimately collapse, bend or deform under load. Also envisioned are materials whose properties can change in response to various fields or currents applied to them. Also envisioned is a variability on the hardness of seal 26 acting in conjunction with sleeves 20 to allow for segment 34 being less resistant to expansion so it will make sealing contact first and the balance getting progressively or suddenly stiffer or harder to promote the desired direction of expansion from up-hole segment 34 to downhole segment 32 of seal 26.

Figure 3:
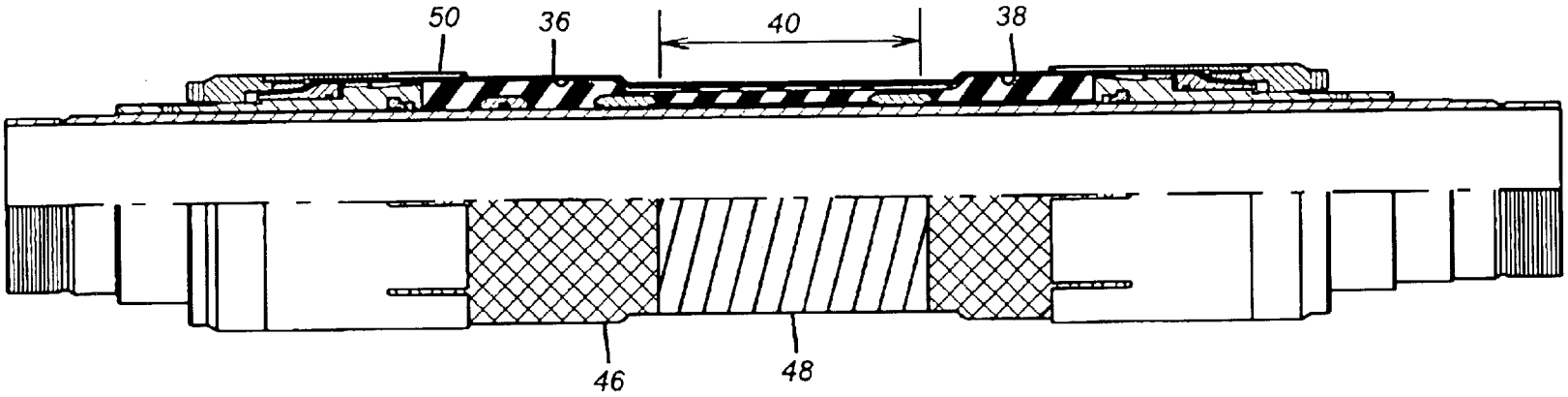
FIG. 3 is the view of FIG. 2 showing the layers above the internal sealing element.
Figure 4:
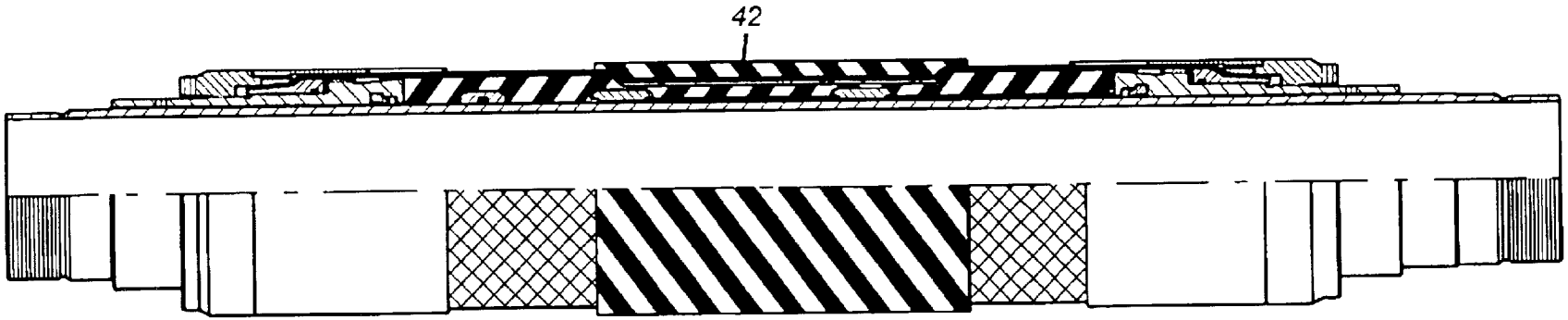
FIG. 4 is the view of FIG. 3 showing the outer sealing element that makes contact with the casing, tubular or borehole.
Figure 5:
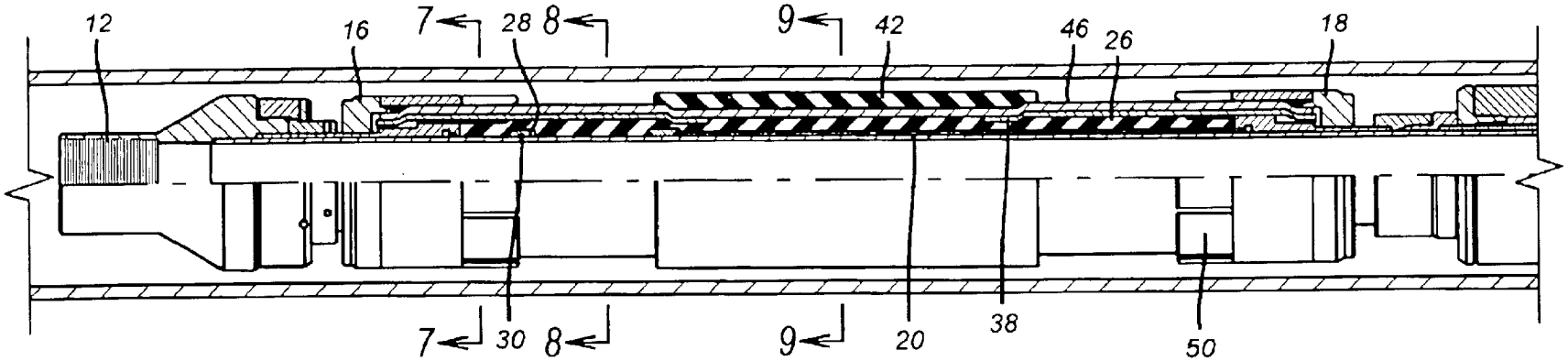
FIG. 5 is a run in view of the assembly in part section.
Figure 6:
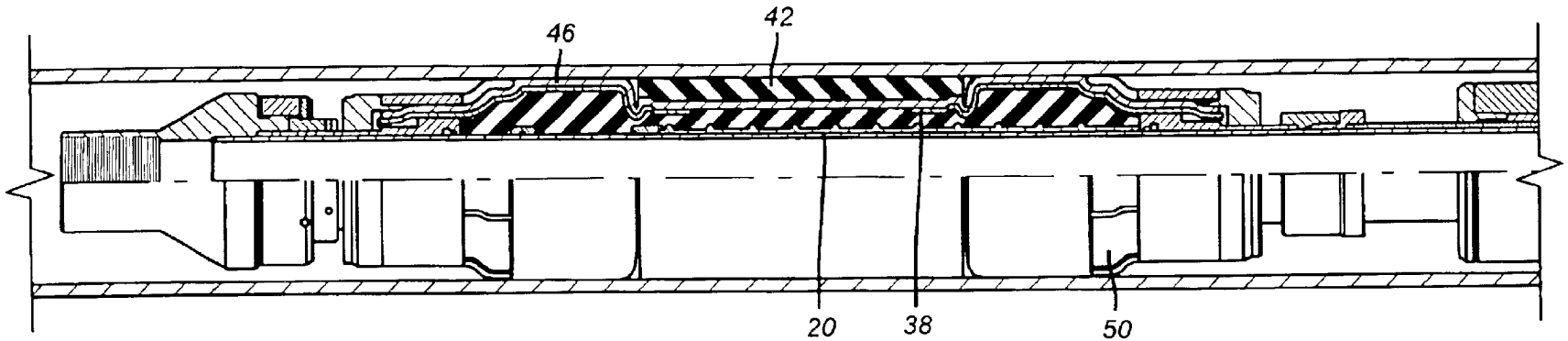
FIG. 6 is the view of FIG. 5 in the set position.
Figure 7:
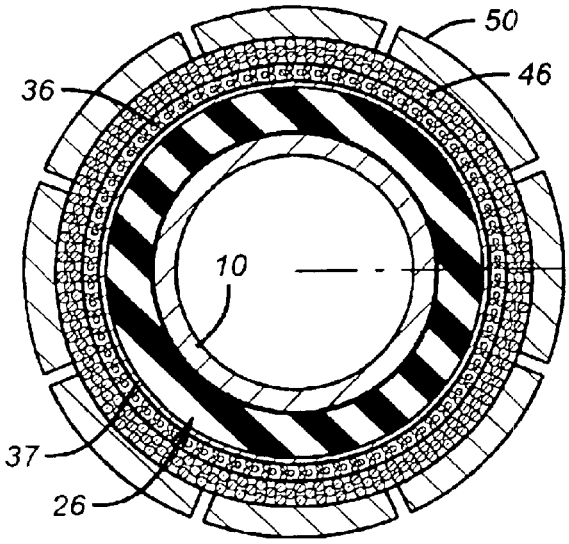
FIG. 7 is a section view along lines 7—7 of FIG. 5.
Figure 8:
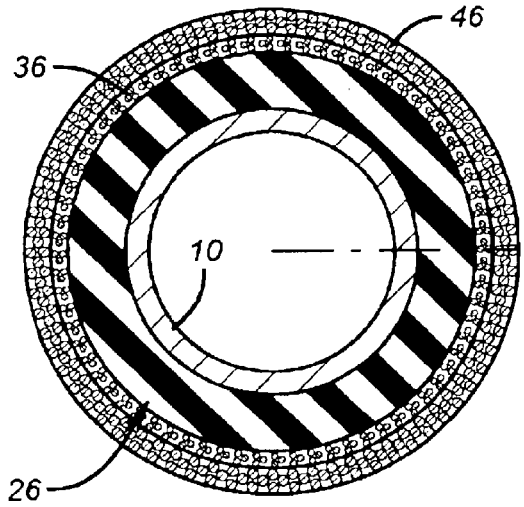
FIG. 8 is a section view along lines 8—8 of FIG. 5.
Figure 9:
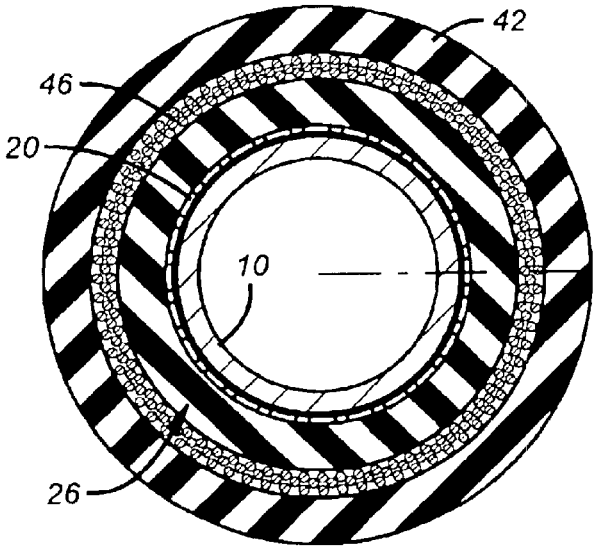
FIG. 9 is a section view along lines 9—9 of FIG. 5.

Apart from the problem of not getting enough contact pressure for a good seal, there is another potential problem that is addressed by the present invention. That problem is element extrusion through end gaps after setting. The solution of the preferred embodiment is shown in FIGS. 3 and 4. FIG. 3 illustrates the use of tubes 36 and 38, which extend respectively from sleeves 16 and 18 and can be seen in the section view at the top of FIG. 3. Tubes 36 and 38 preferably do not cover the length of seal 26 leaving a gap 40 in between. The preferred material is a continuous-aramid, Kevlar or carbon fiber, tube that is mechanically secured at sleeves 16 and 18. Tubes 36 and 38 are preferably constructed of braided fibers to facilitate radial expansion of not only seal 26 but also of outer seal 42 (FIG. 4), which is mounted in a recess 44 (FIG. 2) of seal 26. In the preferred embodiment, the recess 44 is centrally mounted but offset locations can also be used. The recess 44 is optional but its use facilitates the resistance to extrusion after set, as will be explained below. The seal 26 can preferably be a solid rubber mass or segments or a particle material. A particle material offers an added advantage of being able to move freely during the setting operation and a greater ability to conform to irregularities in the shape of the wellbore. The use of tubes 36 and 38 further makes particle materials such as rubber useful because the rubber is elastic and can store energy, which is contained by tubes 36 and 38. These strong tubes are a significant element in keeping the seal 26 from extruding past sleeves 16 or 18. Tubes 36 and 38 can be used alone or can be reinforced with overlaying tube segments 37 (see FIG. 7), secured to sleeves 16 and 18. Such reinforcing tubes can be of the same material or fiberglass matte or woven metal mesh. They would provide additional resistance to extrusion in an area where the mechanical stresses are the greatest.

Another feature is the use of a tube 46, which extends from sleeve 16 to sleeve 18 and is securely attached to both. It is preferably a reinforced steel mesh sleeve which provides support for the element 42 when set because it expands into contact with the casing, tubular or wellbore above and below element 42, thus acting as an extrusion barrier for it. The actual main sealing occurs along the length of element 42 in contact with the wellbore, tubular, or casing. During run in, tube 46 keeps seal 26 in tension to reduce its profile and protects it from abrasion as it is run into the well. Additionally, as the depth increases the additional hydrostatic force applied to an unbalanced piston area in a hydrostatic setting mechanism, helps to keep the seal 26 taut. The use of a recess 44 to mount the seal 42 insures that portions of the tube 46 expand into contact with the wellbore, casing or tubular both above and below seal 42 and preferably in contact with it on both ends to prevent extrusion and, to a lesser extent, apply an additional sealing force.

Optionally, a barrier material 48 having some lubricity can be applied over tube 46 but under seal 42. The preferred material is PTFE and its presence keeps the seal 42 from bonding to seal 26 through tube 46. Other materials such as a mold release can also be used. The objective is to keep adjacent seal components from bonding to each other. If the material further promotes sliding, due to its lubricating qualities, then its performance is even better. As previously stated, tubes 36 and 38 leave a gap 40 in between and the barrier material, preferably in the form of tape can span that gap 40, thus keeping rubber from seal 42 from bonding to seal 26 at gap 40. The presence of the barrier material 48 allows seal 46 to move into uniform contact with the surrounding environment without kinking or binding.

Those skilled in the art will appreciate that the packing element described above insures proper expansion of the underlying or fill material of seal 26 beginning at the end furthest from where the expansion force is being applied. This is accomplished by channeling the applied force to the remote end by a force transfer mechanism such as sleeves 20. The force transfer mechanism, by design, is overcome after the upper segment 34 is firmly against a surrounding surface to allow the balance of the seal 26 at its lower segment 32 to complete the expansion. While that is going on tubes 36 and 38 and any backup tubes guard against extrusion. The outer seal 42 can expand against the surrounding surface and be surrounded above and below by portions of the mesh tube 46. For additional protection against extrusion, the ends of the sleeves 16 and 18 can have longitudinal splits giving the effect of long fingers. These fingers 50 are spread against the surrounding space to give an added extrusion barrier. They can be held together initially for run in so as to keep them out of the way. Additionally, tube 46 keeps the run in profile low as well as serving as an extrusion barrier to both seal 26 and outer seal 42.

The above description is representative of the preferred embodiment and the various modifications and alterations that can be made within the scope of the invention are clearly defined below in the appended claims:

We claim:

1. A packer for downhole use, having an uphole and a downhole end, comprising:

a body:

a first sealing element on said body with a first and second sleeve, said sleeves disposed one near each end, said first sleeve movable to extend said sealing element into a set position by compression caused by relative movement with respect to said second sleeve; a force distribution member acting on said first sealing element to promote transmission of a compressive force applied from movement of said first sleeve into initial movement toward said set position of said sealing element in a region adjacent said second sleeve.

2. The packer of claim 1, wherein:

said first sleeve is disposed closer to the downhole end and said second sleeve is disposed closer to said uphole end.

3. The packer of claim 1, wherein:

said force distribution member comprises a hardness variation in said sealing element wherein said sealing element is harder adjacent said first sleeve than said second sleeve.

4. The packer of claim 1, wherein:

said force distribution member comprises at least one spring that collapses after said initial movement toward said set position of said sealing element in a region adjacent said second sleeve.

5. The packer of claim 1, further comprising:

at least one tube overlaying said first sealing element and extending from at least one of said first and second sleeves for a portion of the length of said first sealing element to resist extrusion of said first sealing element adjacent at least one of its ends.

6. The packer of claim 5, wherein:

said at least one tube further comprises reinforcing.

7. The packer of claim 1, further comprising:

a cover tube, extending from said first to said second sleeve and overlying said first sealing element in a manner as to keep it in tension for run in with its profile reduced.

8. The packer of claim 7, further comprising:

an outer seal overlying said cover tube such that upon movement of said first sleeve, said cover tube expands on opposed sides of said outer seal to limit extrusion thereof.

9. The packer of claim 8, further comprising:

a lubricious material covering said cover tube and in a zone where said lubricious material is substantially overlaid by said outer seal to minimize a tendency of said first seal to bond to said outer seal.

10. The packer of claim 8, wherein:

said first seal defines an outer recess where said outer seal is disposed.

11. A packer for downhole use, having an uphole and a downhole end, comprising:

a body:

a first sealing element on said body with a first and second sleeve, said sleeves disposed one near each end, said first sleeve movable to extend said sealing element into a set position by compression caused by relative movement with respect to said second sleeve; a force distribution member acting on said first sealing element to promote transmission of a compressive force applied from movement of said first sleeve into initial movement toward said set position of said sealing element in a region adjacent said second sleeve;

said force distribution member further comprises at least one tubular member extending from adjacent said first sleeve and configured to have limited column strength such that it buckles after said initial movement toward said set position of said first sealing element in a region adjacent said second sleeve.

12. The packer of claim 11, wherein:

said tubular member is made of a material whose strength can be varied by an applied field or current for selective weakening after said initial movement toward said set position of said sealing element in a region adjacent said second sleeve.

13. The packer of claim 11, wherein:

said force distribution member comprises a plurality of cylinders separated by spacers to distribute compressive force from one cylinder to an adjacent cylinder.

14. The packer of claim 13, wherein:

said cylinders have a plurality of openings to control their column strength.

15. The packer of claim 14, wherein:

said cylinders have a sealed seam or comprise a sheet scrolled into a cylindrical shape.

16. The packer of claim 15, wherein:

said cylinders have decreasing column strength with the strongest disposed adjacent said first sleeve.

17. The packer of claim 11, wherein:

the strength of said tubular member decreases going away from said first sleeve.

18. A packer for downhole use, having an uphole and a downhole end, comprising:

a body:

a first sealing element on said body with a first and second sleeve, said sleeves disposed one near each end, said first sleeve movable to extend said sealing element into a set position by compression caused by relative movement with respect to said second sleeve;

a force distribution member acting on said first sealing element to promote transmission of a compressive force applied from movement of said first sleeve into initial movement toward said set position of said sealing element in a region adjacent said second sleeve;

a cover tube, extending from said first to said second sleeve and overlying said first sealing element in a manner as to keep it in tension for run in with its profile reduced;

an outer seal overlying said cover tube such that upon movement of said first sleeve, said cover tube expands on opposed sides of said outer seal to limit extrusion thereof;

said first seal defines an outer recess where said outer seal is disposed;

said at least one tube comprises two tubes with one extending part way along said first sealing element from each of said first and second sleeves to define a gap along said first sealing element, said outer recess in general alignment with said gap.

19. The packer of claim 18, wherein:

a lubricious material covering said cover tube and in a zone where said lubricious material is substantially overlaid by said outer seal to minimize a tendency of said first seal to bond to said outer seal.

20. A packer for downhole use, having an uphole and a downhole end, comprising:

a body:

a first sealing element on said body with a first and second sleeve, said sleeves disposed one near each end, said first sleeve movable to extend said sealing element into a set position by compression caused by relative movement with respect to said second sleeve;

a force distribution member acting on said first sealing element to promote transmission of a compressive force applied from movement of said first sleeve into initial movement toward said set position of said sealing element in a region adjacent said second sleeve;

at least one of said first and second sleeves is split to allow for expansion thereof upon compression of said first sealing element so as to minimize extrusion of said first sealing element.

* * * * *